US010463161B2

(12) United States Patent
Johnson et al.

(10) Patent No.: US 10,463,161 B2
(45) Date of Patent: Nov. 5, 2019

(54) FURNITURE LIFTING SYSTEM

(71) Applicant: Lippert Components, Inc., Elkhart, IN (US)

(72) Inventors: Chad Johnson, Kaysville, UT (US); Gary Scothern, Layton, UT (US); Aaron Rasmussen, Fruit Heights, UT (US)

(73) Assignee: Lippert Components, Inc., Elkhart, IN (US)

( * ) Notice: Subject to any disclaimer, the term of this patent is extended or adjusted under 35 U.S.C. 154(b) by 336 days.

(21) Appl. No.: 15/660,938

(22) Filed: Jul. 26, 2017

(65) Prior Publication Data

US 2018/0027978 A1 Feb. 1, 2018

Related U.S. Application Data

(60) Provisional application No. 62/366,990, filed on Jul. 26, 2016.

(51) Int. Cl.

| | |
|---|---|
| ***A47C 19/22*** | (2006.01) |
| ***A47C 17/84*** | (2006.01) |
| ***A47C 17/86*** | (2006.01) |
| ***A47C 19/04*** | (2006.01) |
| ***A47C 19/02*** | (2006.01) |
| *A47C 17/00* | (2006.01) |

(52) U.S. Cl.

CPC ..... *A47C 19/22* (2013.01); *A47C 17/84* (2013.01); *A47C 17/86* (2013.01); *A47C 19/021* (2013.01); *A47C 17/00* (2013.01); *A47C 19/04* (2013.01)

(58) Field of Classification Search

CPC ..... A47C 17/84; A47C 17/86; A47C 19/00; A47C 19/04; A47C 19/045; A47C 31/00; A47C 19/22; A61G 7/012; A61G 13/06

USPC ..... 5/11, 10.1, 10.2, 600, 611

See application file for complete search history.

(56) References Cited

U.S. PATENT DOCUMENTS

| | | | | | |
|---|---|---|---|---|---|
| 3,648,304 | A * | 3/1972 | Ogui | A47B 96/1425 | 5/10.1 |
| 3,665,527 | A * | 5/1972 | Gonzalez | A47C 17/84 | 5/10.2 |
| 4,837,877 | A * | 6/1989 | Hamada | A47C 17/84 | 5/10.2 |
| 5,020,169 | A * | 6/1991 | Hamada | A47C 17/84 | 5/10.2 |
| 5,056,170 | A * | 10/1991 | Kronshagen | A47C 17/84 | 254/92 |
| 6,550,081 | B2 * | 4/2003 | Vilsmeier | A47C 17/84 | 5/11 |

(Continued)

*Primary Examiner* — Robert G Santos

(74) *Attorney, Agent, or Firm* — Holland & Hart, LLP

(57) ABSTRACT

A structure includes an item of furniture coupled to a lift system. The lifting system is configured to move the item of furniture vertically along a path between a lowered position and a raised position. The item of furniture is coupled to the lifting system in a manner that allows the item of furniture to move upward along the path when the lifting system is stationary. When the item of furniture is in the lowered position, it is supported on the floor of the structure. This configuration allows the item of furniture to float relative to the lifting system so that when the item of furniture reaches the lowered position, it is supported only by the floor and not the lifting system.

23 Claims, 15 Drawing Sheets

(56) References Cited

U.S. PATENT DOCUMENTS

| | | | | |
|---|---|---|---|---|
| 6,651,273 | B2 * | 11/2003 | Vilsmeier | A47C 17/84 5/10.2 |
| 6,698,040 | B1 * | 3/2004 | Acevedo | A47C 17/84 5/10.1 |
| 7,874,026 | B2 * | 1/2011 | Gudenkauf | A47C 17/84 5/10.1 |
| 9,380,881 | B2 | 7/2016 | Rasmussen | |
| 2002/0046423 | A1 * | 4/2002 | Vilsmeier | A47C 17/84 5/11 |
| 2002/0088052 | A1 * | 7/2002 | Vilsmeier | A47C 17/84 5/133 |
| 2009/0049602 | A1 * | 2/2009 | Gudenkauf | A47C 17/84 5/11 |
| 2018/0027978 | A1 * | 2/2018 | Johnson | A47C 19/22 |

* cited by examiner

FURNITURE LIFTING SYSTEM

BACKGROUND

Lifting mechanisms have been successfully used for a number of years to lift various items in various situations. One particularly popular use is to lift beds and/or seating units in vehicles and other situations where space is limited. The '881 patent identified at the end of the description discloses a number of lifting mechanisms that can be used for a variety of purposes.

Although conventional lifting mechanisms have enjoyed a significant amount of commercial success, they can still pose problems in certain situations. One of those situations occurs when the lifting mechanism is used to lower an object onto the floor or onto a support base positioned on the floor. The problem is that the object is fixed to the lifting mechanism so that it must be lowered to exactly the right height to be fully supported by the floor. If it isn't lowered far enough, then it won't be supported by the floor. It will be supported primarily or entirely by the lifting mechanism. If it is lowered too far, then the lifting mechanism pushes the object downward into the floor, which increases wear and tear on the lifting mechanism.

These problems are magnified when the object is configured to closely correspond to a support base positioned on the floor. Any misalignment will create gaps between the object and the support base, which indicate that the object is not fully supported by the support base and is at least partially supported by the lifting mechanism.

These problems were addressed in one of two ways in the past. The first way is to mount the lifting mechanism in exactly the location required for the object to be properly supported on the floor or by the support base. This is time consuming and unforgiving. There is little or no room for error. The second way is to provide some way to adjust the position of the object when it is in the lowered position so that it is properly supported by the floor or the support base. This introduces additional mechanical complexity to the mechanism and/or object and requires an additional adjustment procedure after everything has been mounted. Both increase the cost and/or time required to manufacture and/or install the system.

SUMMARY

A structure includes a lifting system configured to move an item of furniture vertically between a lowered position and a raised position. The item of furniture is coupled to the lifting system so that the item of furniture can "float" as it moves between the lowered position and the raised position. The lifting system supports the item of furniture and controls its downward movement. At the same time, the item of furniture is not rigidly attached to the lifting system so it is free to move upward relative to the lifting system. This is what is meant by the item of furniture being allowed to float as it moves between the lowered position and the raised position.

One of the advantages of this configuration is that the lifting system can lower the item of furniture so that it is fully supported by the floor and/or a support base without worrying about whether the lifting system was installed perfectly and without any complicated adjustment mechanisms or steps. Because the item of furniture floats relative to the lifting system, the lifting system can be lowered until no part of the item of furniture is supported by the lifting system.

The lifting system can have a variety of configurations. In some embodiments, the lifting system includes a plurality of moving members that support but are not attached to the item of furniture. The lifting system lowers the item of furniture until it is supported by the floor and/or the support base. At this point, the moving members continue moving downward so that they no longer support the item of furniture. The point at which each moving member no longer supports the item of furniture can vary to compensate for variation and imprecision in the system. For example, one corner or side of the item of furniture can contact the floor and/or support base first while another side contacts it only after moving another inch lower.

The Summary is provided to introduce a selection of concepts in a simplified form that are further described below in the Detailed Description. The Summary and the Background are not intended to identify key concepts or essential aspects of the disclosed subject matter, nor should they be used to constrict or limit the scope of the claims. For example, the scope of the claims should not be limited based on whether the recited subject matter includes any or all aspects noted in the Summary and/or addresses any of the issues noted in the Background.

DRAWINGS

The preferred and other embodiments are disclosed in association with the accompanying drawings in which.

DETAILED DESCRIPTION

Figure 1:
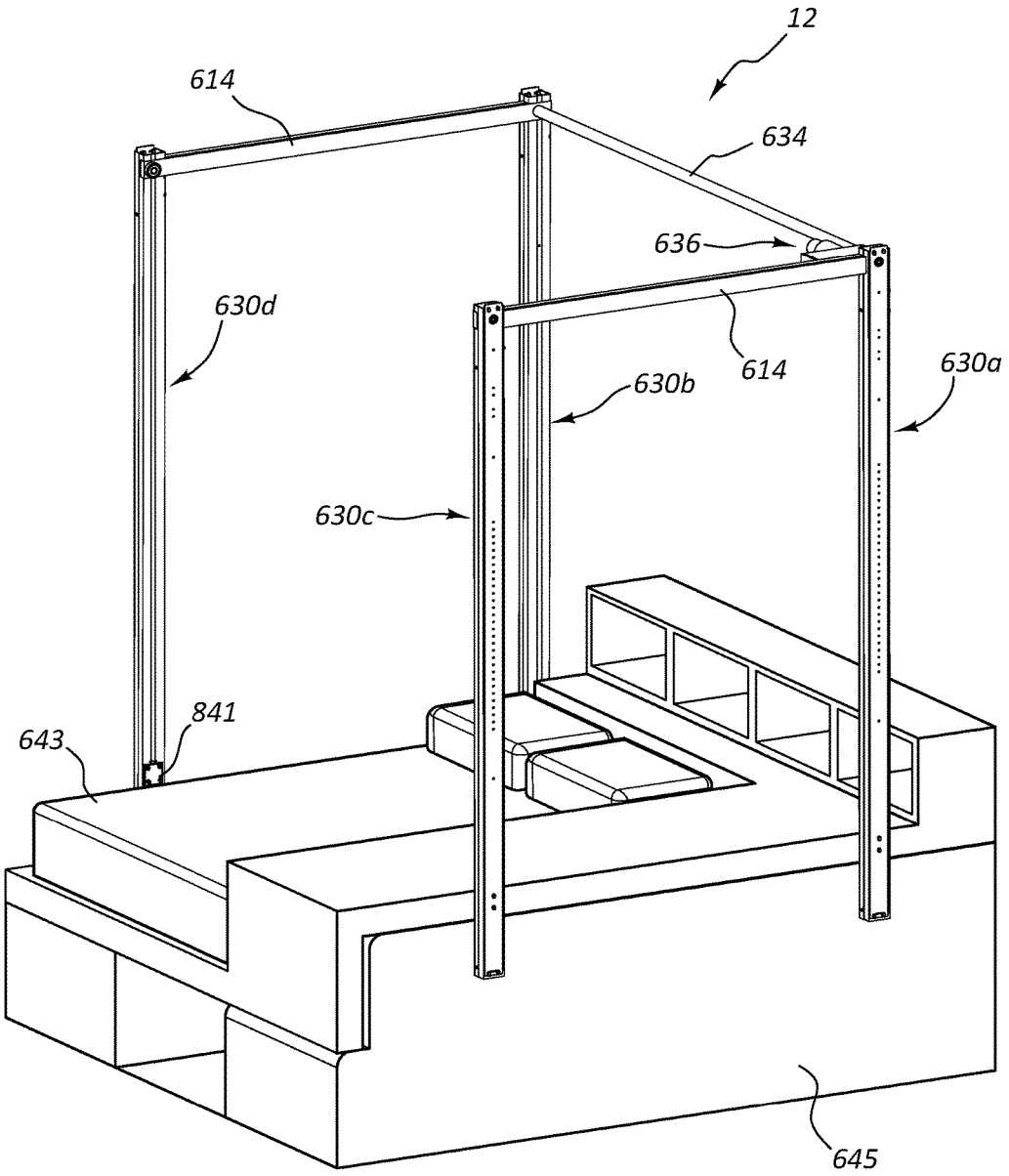
FIG. 1 is a perspective view of one embodiment of a lift system configured to move an item of furniture between a lowered position and a raised position. The item of furniture is shown in the lowered position.
Figure 2:
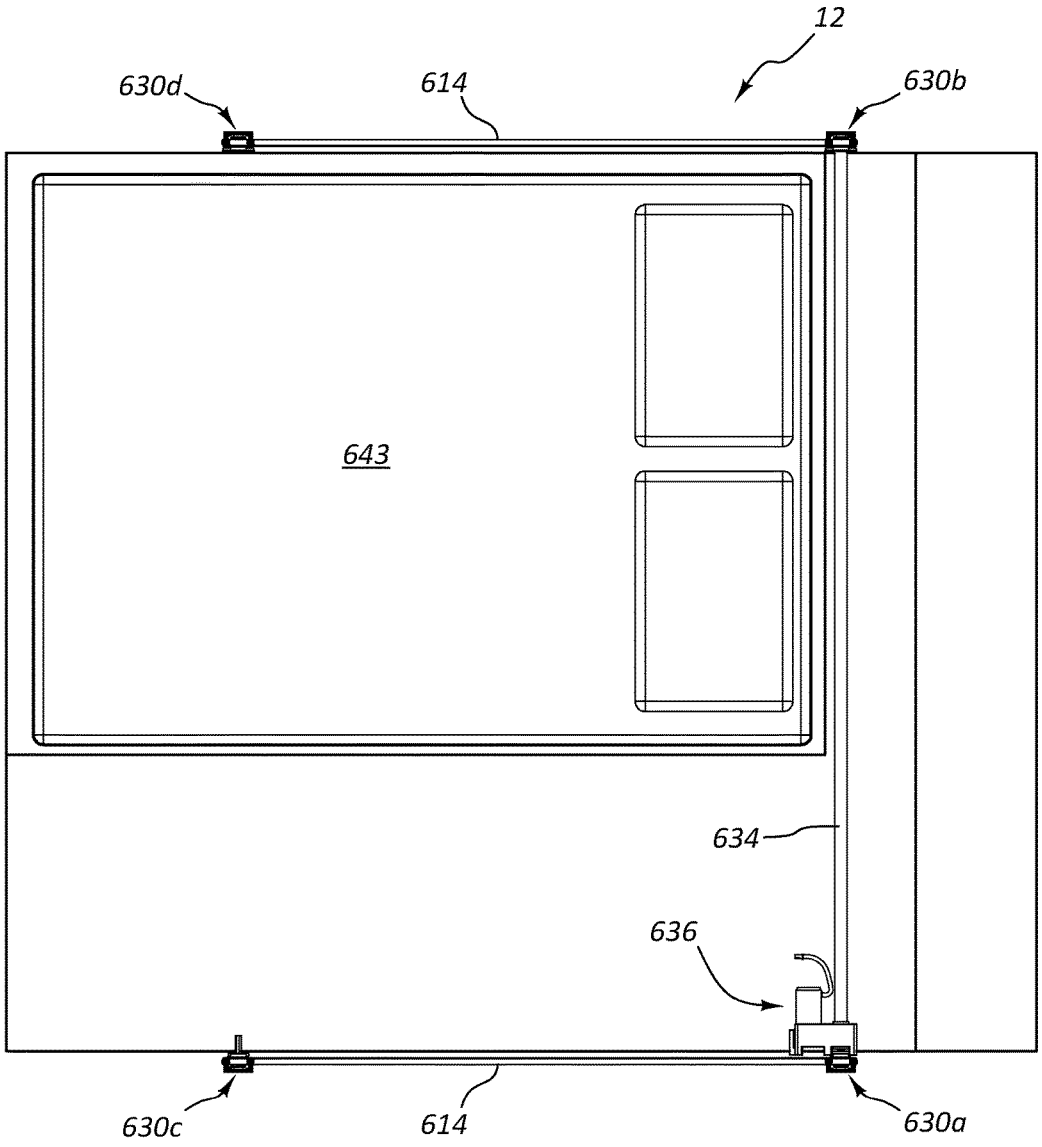
FIG. 2 is a top view of the lift system in FIG. 1.
Figure 3:
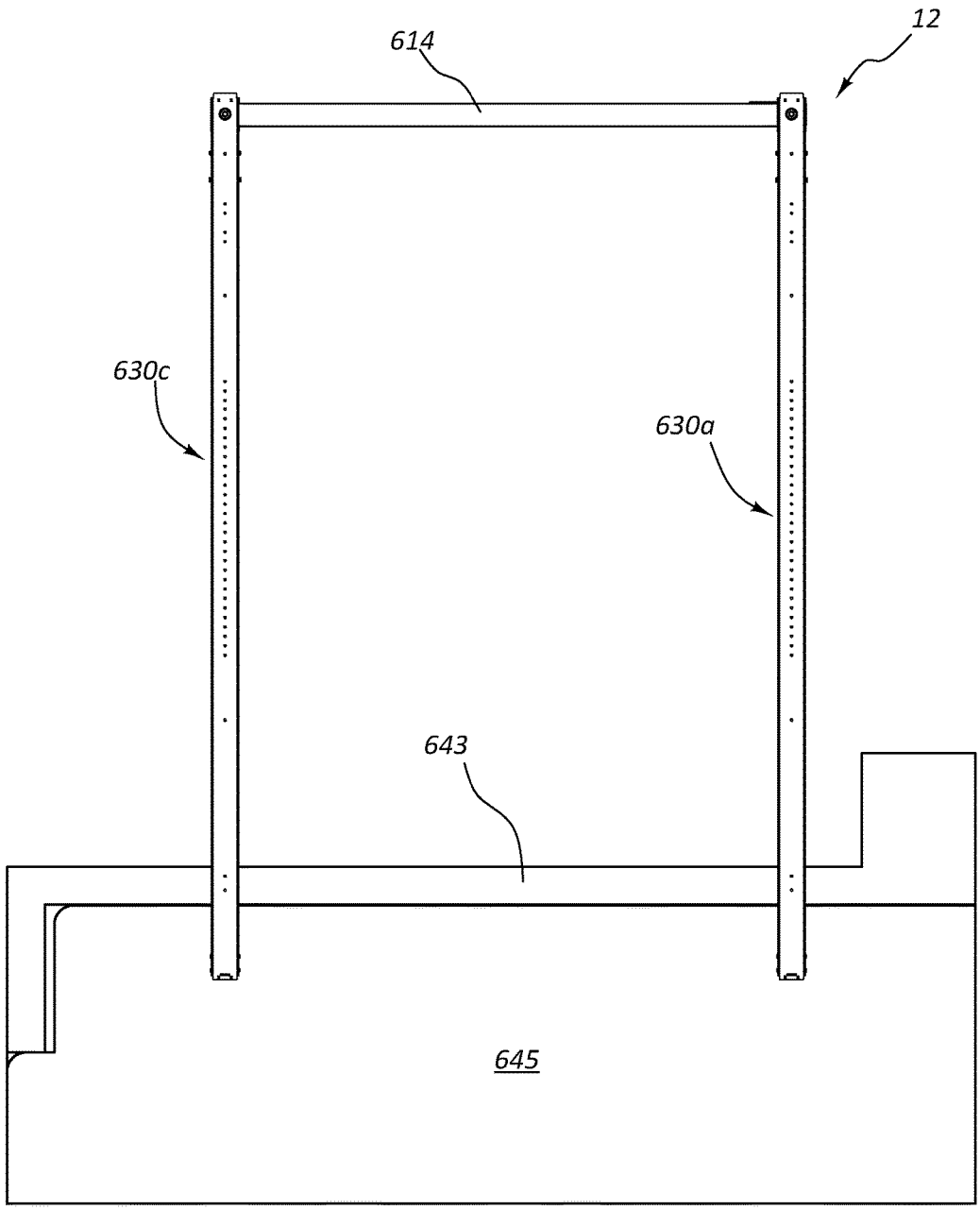
FIG. 3 is a right side view of the lift system in FIG. 1.
Figure 4:
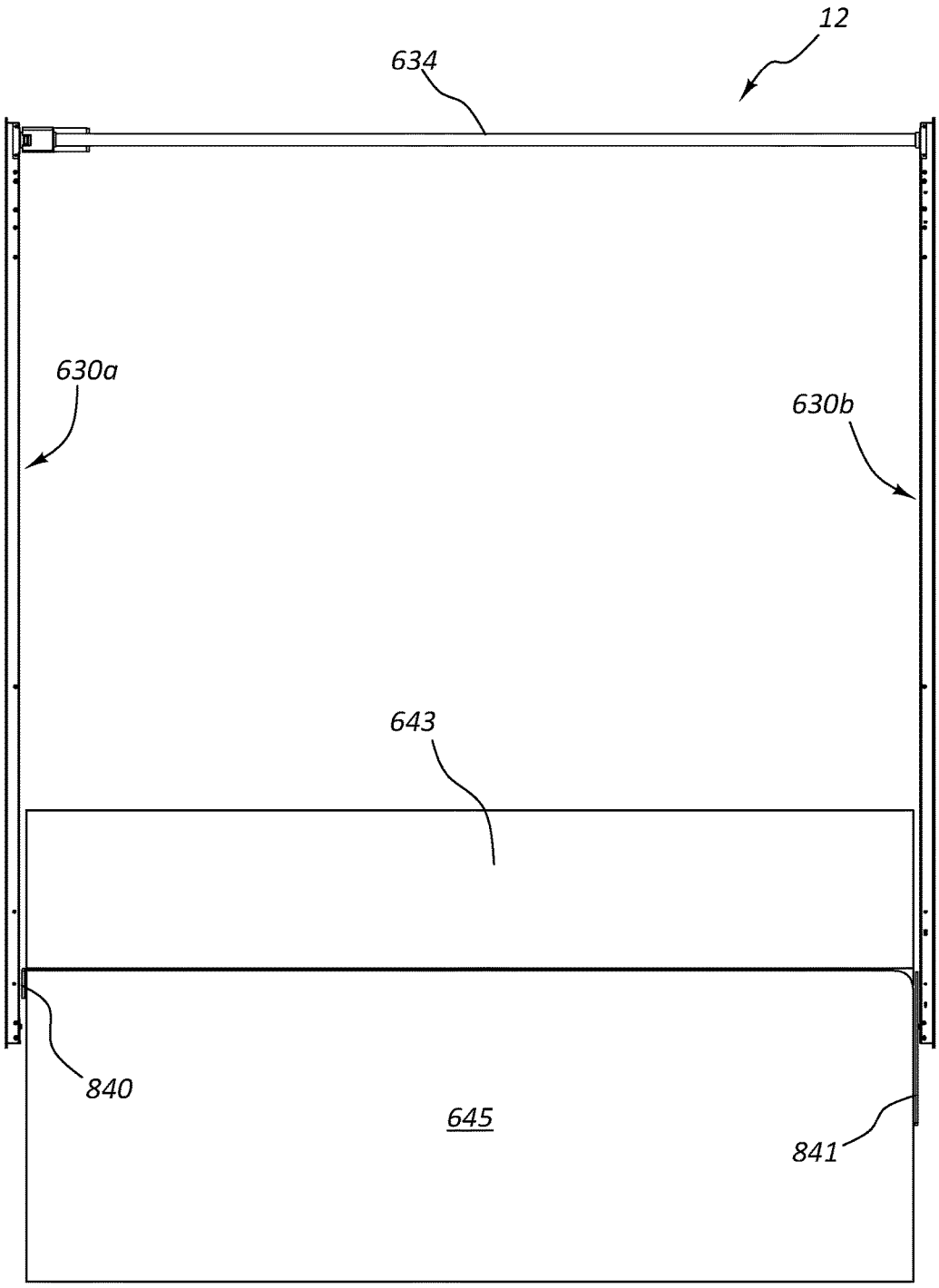
FIG. 4 is a rear view of the lift system in FIG. 1.
Figure 5:
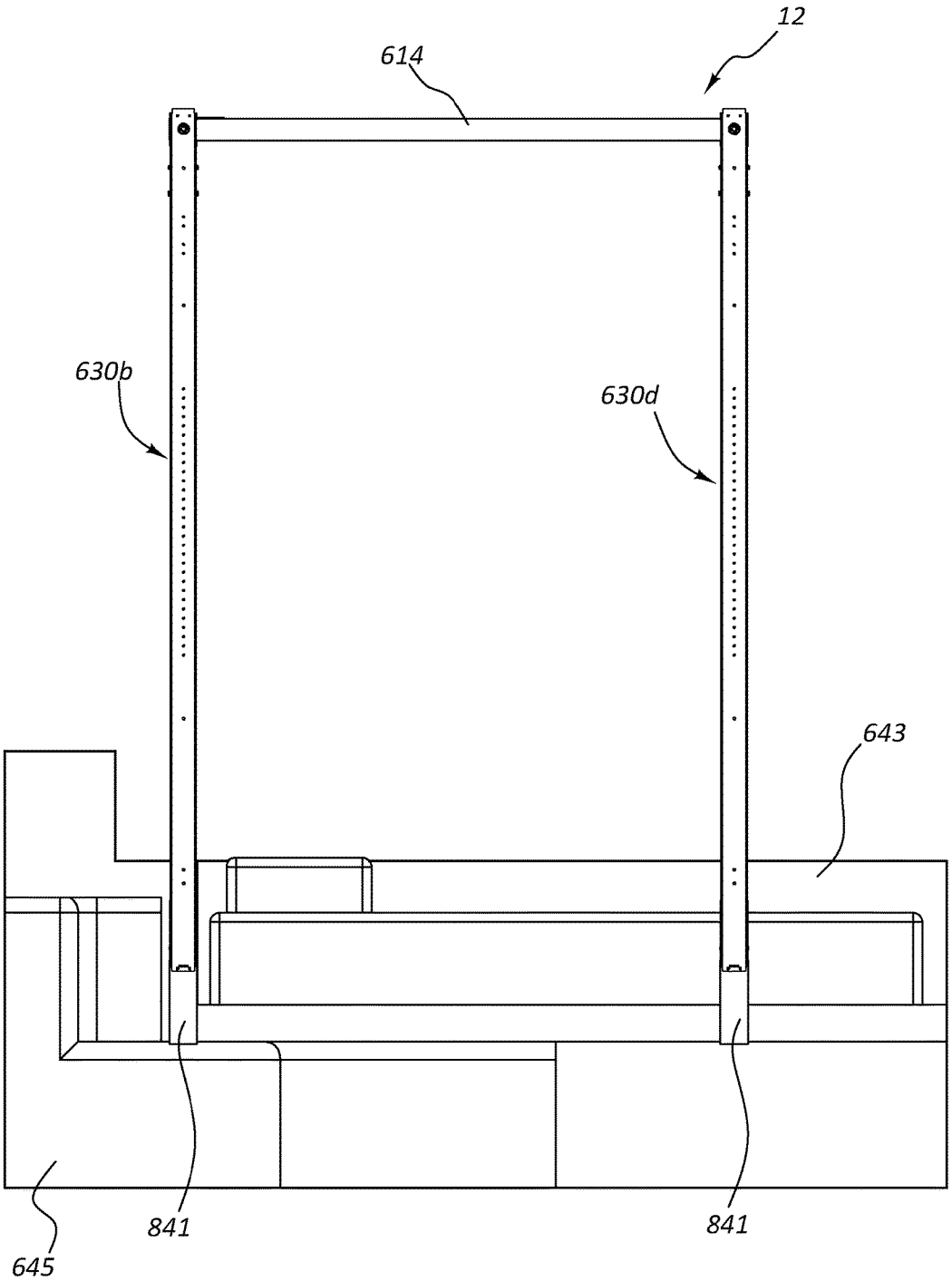
FIG. 5 is a left side view of the lift system in FIG. 1.

FIG. 1 shows one embodiment of a lifting system 12 that can be used to move an item of furniture 643 between a lowered position and a raised position. The item of furniture 643 rests on a support base 645 when it is in the lowered position. FIGS. 1-5 show the item of furniture 643 in the lowered position, and FIGS. 8-11 show the item of furniture 643 in the raised position.

The item of furniture 643 shown in the Figs. includes a bed with a mattress. It also includes storage cubbies and a flat working surface. It should be appreciated, however, that the item of furniture 643 can be or include any suitable item of furniture such as a sofa, couch, chair, bench, and the like; sleeping unit such as a bed, mattress, and the like; a dining unit such as a dinette, table, counter, and the like; a desk; a workbench; an entertainment center; and the like. The lifting system 12 can also be configured to lift any of the other objects disclosed in the '881 patent.

When the item of furniture 643 is in the raised position, the support base 645 forms a seating arrangement including a coffee table. In this manner, the support base 645 forms another item of furniture. The bottom side of the item of furniture 643 is configured to correspond to and be supported by the upper side of the support base 645. The item of furniture 643 and the support base 645 are an example of a configuration that would be particularly difficult to fit together using conventional lifting system configurations but is relatively easy to fit together using the lifting system 12.

The lifting system 12 can have any suitable configuration. Examples of suitable lifting systems can be found in the '881 patent. The lifting system 12 shown in the drawings is described at a high level below. It should be appreciated that additional details regarding the lifting system 12 and other lifting systems that can be used to lift the item of furniture can be found in the '881 patent.

The lifting system 12 includes lifting assemblies 630*a*, 630*b*, 630*c*, 630*d* (collectively referred to as "the lifting assemblies 630"; alternatively referred to herein as sliding assemblies or sliding mechanisms), a drive member 634 (alternatively referred to herein as synchronizing assemblies, synchronizing members, or timing assemblies), cross members 614, and a motor assembly 636.

The lifting assemblies 630 can be free standing or can be coupled to the walls of the structure. The lifting assemblies 630*a*, 630*c* are positioned opposite to the lifting assemblies 630*b*, 630*d*, respectively. The lifting assemblies 630 are used to vertically move the item of furniture 643 between the lowered position shown in FIGS. 1-5 and the raised position shown in FIGS. 8-11. The drive member 634 synchronizes movement of the pair of lifting assemblies 630*a*, 630*c* and the pair of lifting assemblies 630*b*, 630*d*. The motor assembly 636 drives the lifting assemblies 630.

In the embodiment shown in the Figs., four lifting assemblies 630 are used to vertically move the item of furniture 643. In other embodiments, one, two, three, five, six, or more lifting assemblies 630 may be used to lift the item of furniture 643. The lifting assemblies 630 can be free standing, coupled to the same side wall, opposing side walls, or on side walls which are perpendicular to each other. Thus, many configurations of the lifting assemblies 630 can be provided to vertically move the item of furniture 643.

A cross member 614 can be coupled between the lifting assemblies 630*a*, 630*c* and the lifting assemblies 630*b*, 630*d*. The combination of each pair of the lifting assemblies 630 and the cross member 614 forms a rigid structure which can be coupled to the structure. Also, the cross member 614 can be used to conceal a flexible drive member 632, 638 (FIGS. 6-7) such as a chain, cable, toothed belt, or strap which moves behind or inside the cross member 614.

The lifting assemblies 630*a*, 630*b*, 630*c*, 630*d* each include a lower moving assembly 650*a*, 650*b*, 650*c*, 650*d* (collectively referred to as "the lower moving assemblies 650"), an upper moving assembly 651*a*, 651*b*, 651*c*, 651*d* (collectively referred to as "the upper moving assemblies 651")—the moving assemblies 650, 651 can alternatively be referred to herein as carriages, trolleys, sliding units, or moving guide assemblies—and a guide assembly 660*a*, 660*b*, 660*c*, 660*d* (collectively referred to as "the guide assemblies 660")—alternatively referred to herein as a support assembly.

Figure 6:
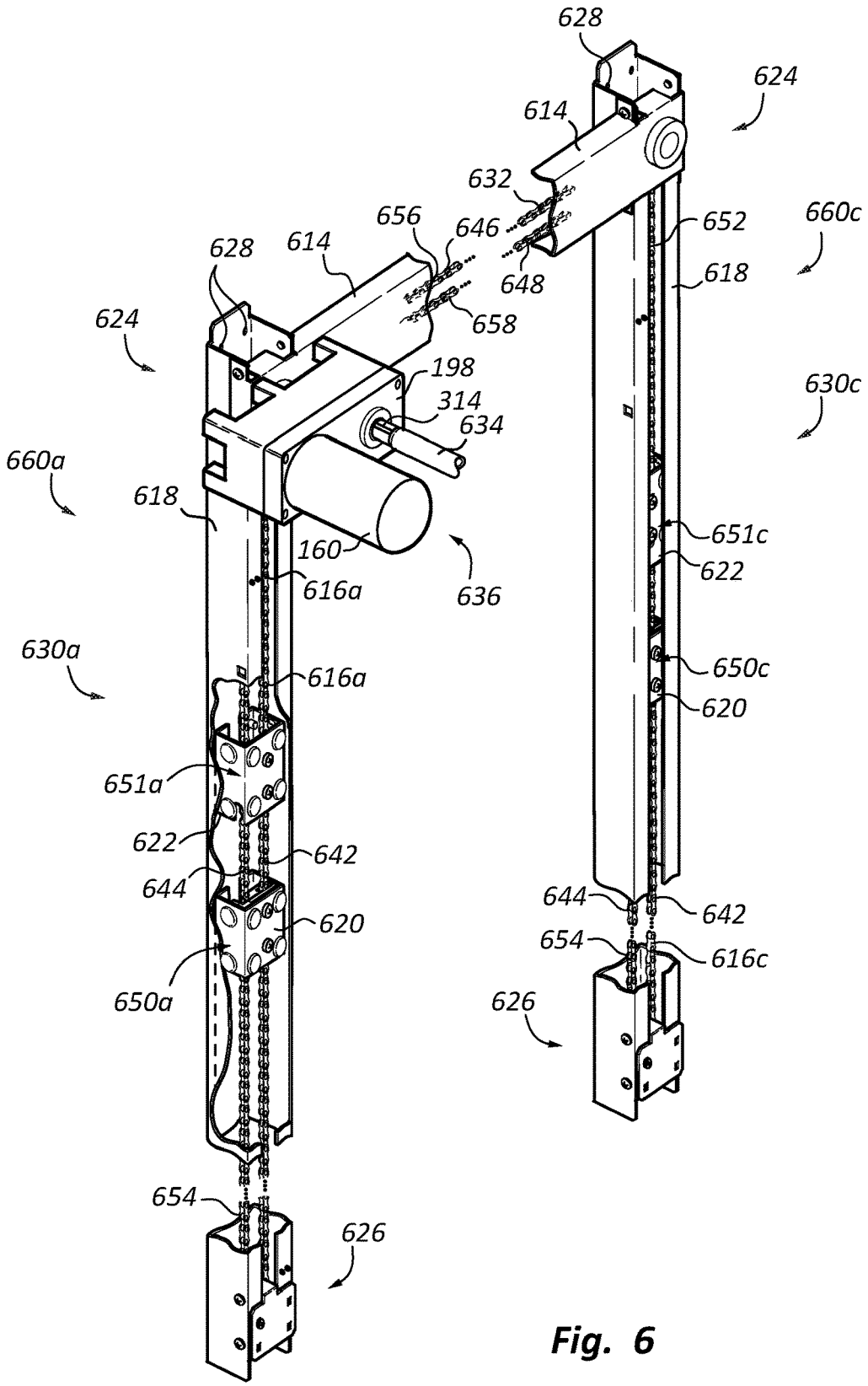
FIG. 6 is a partially cut-away, perspective view of the right half of the lift system in FIG. 1.
Figure 7:
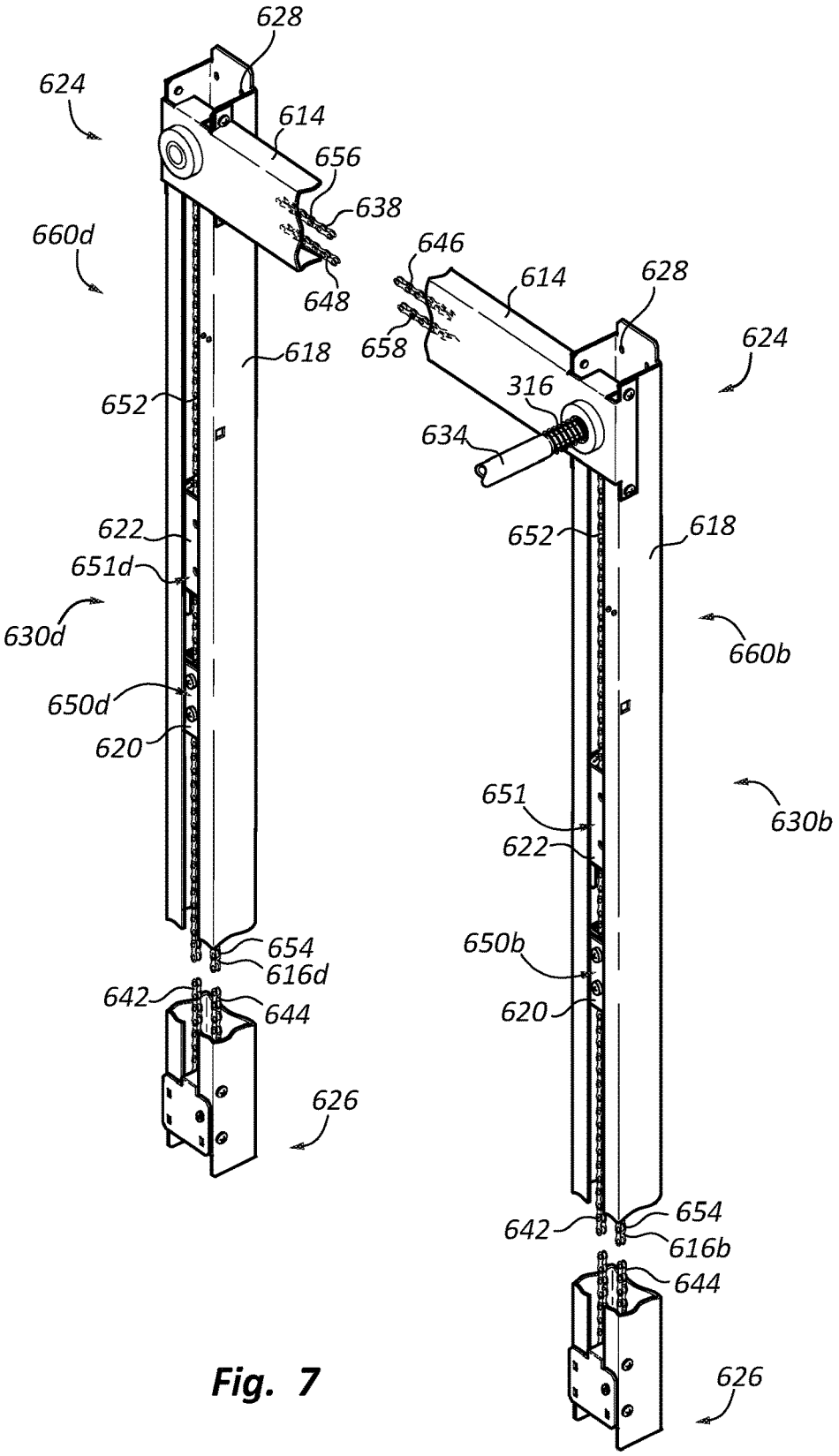
FIG. 7 is a perspective view of the left half of the lift system in FIG. 1.
Figure 8:
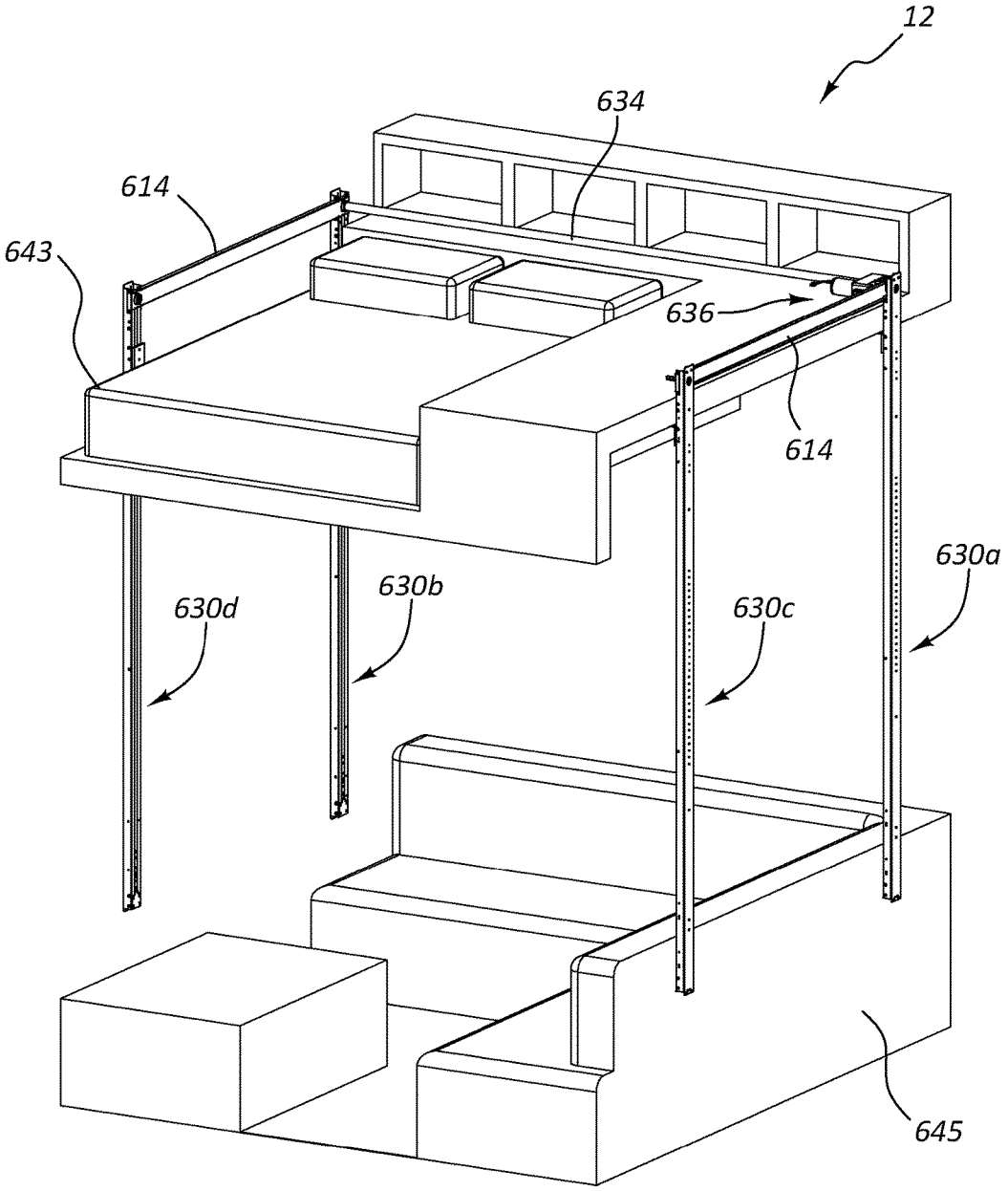
FIG. 8 is a perspective view of the lift system in FIG. 1 with the item of furniture in the raised position.
Figure 9:
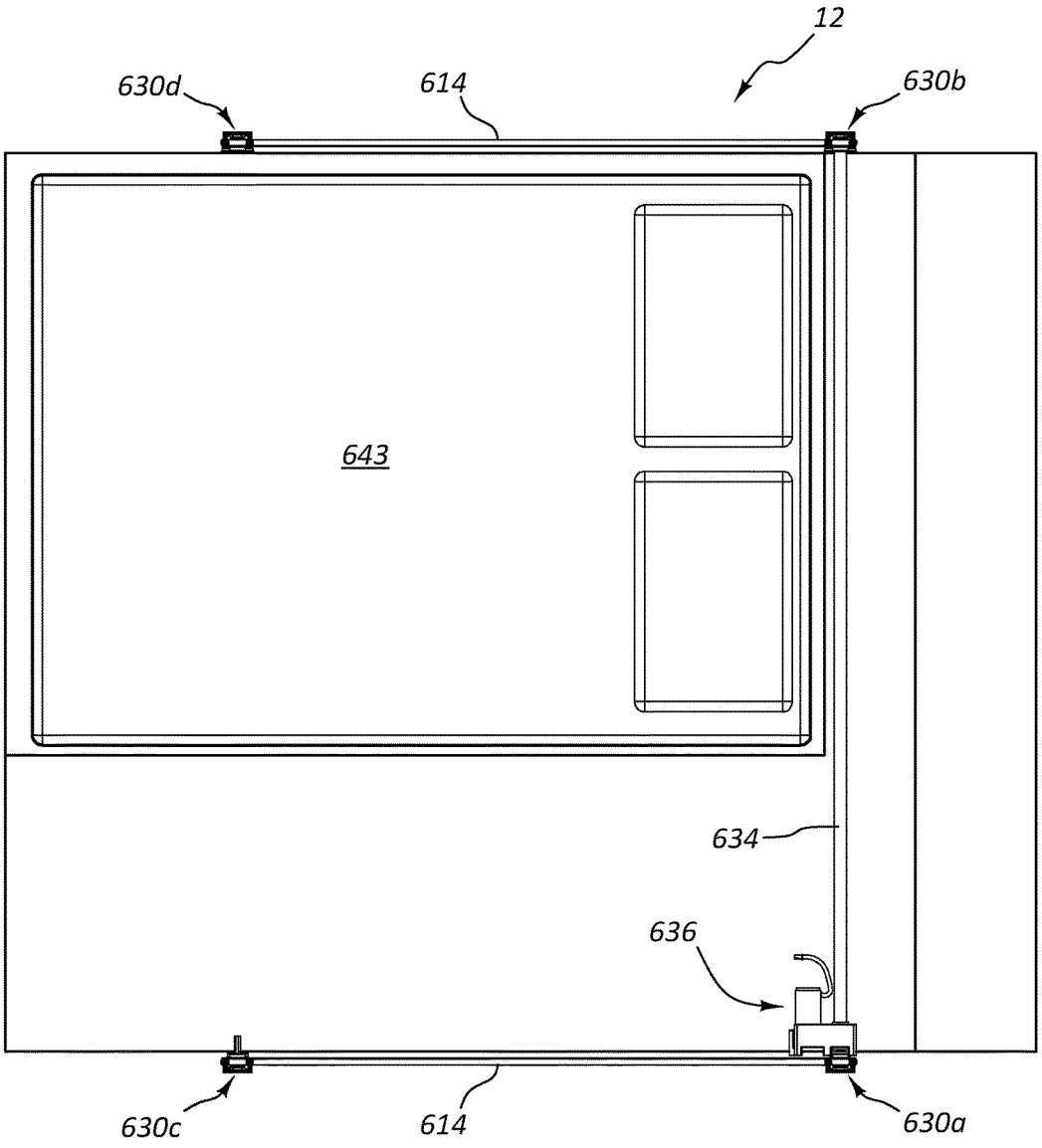
FIG. 9 is a top view of the lift system in FIG. 8.
Figure 10:
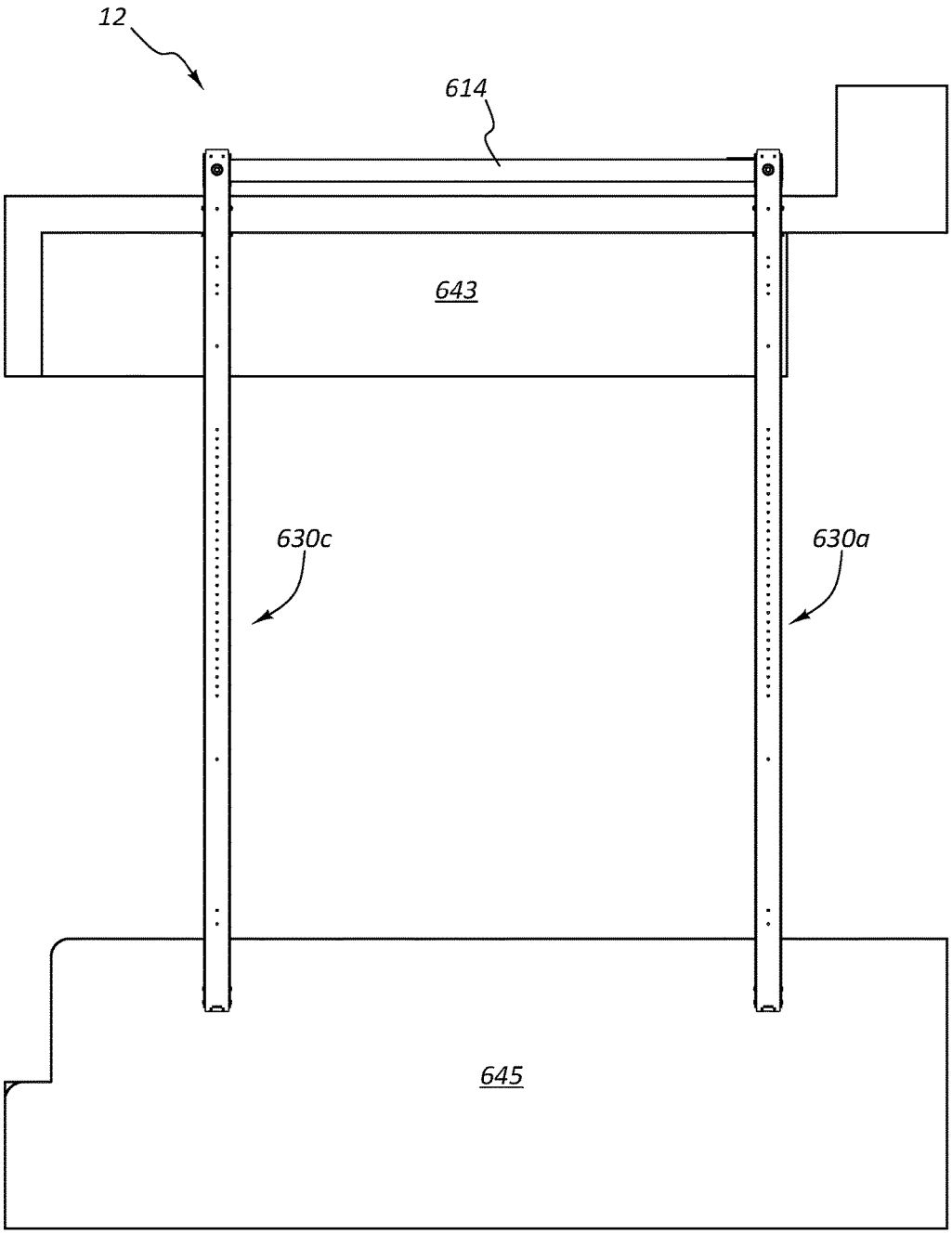
FIG. 10 is a right side view of the lift system in FIG. 8.
Figure 11:
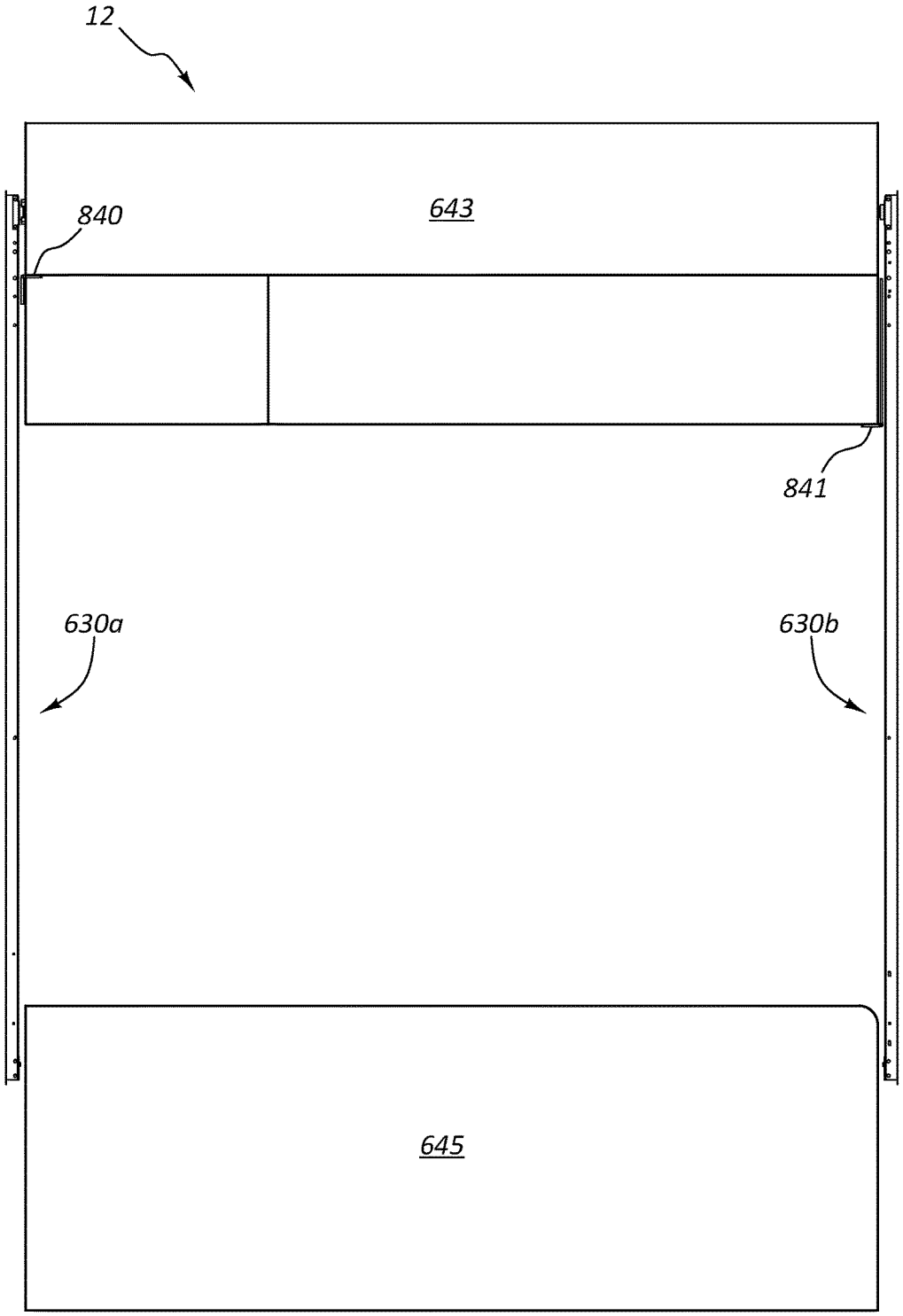
FIG. 11 is a rear view of the lift system in FIG. 8.
Figure 12:
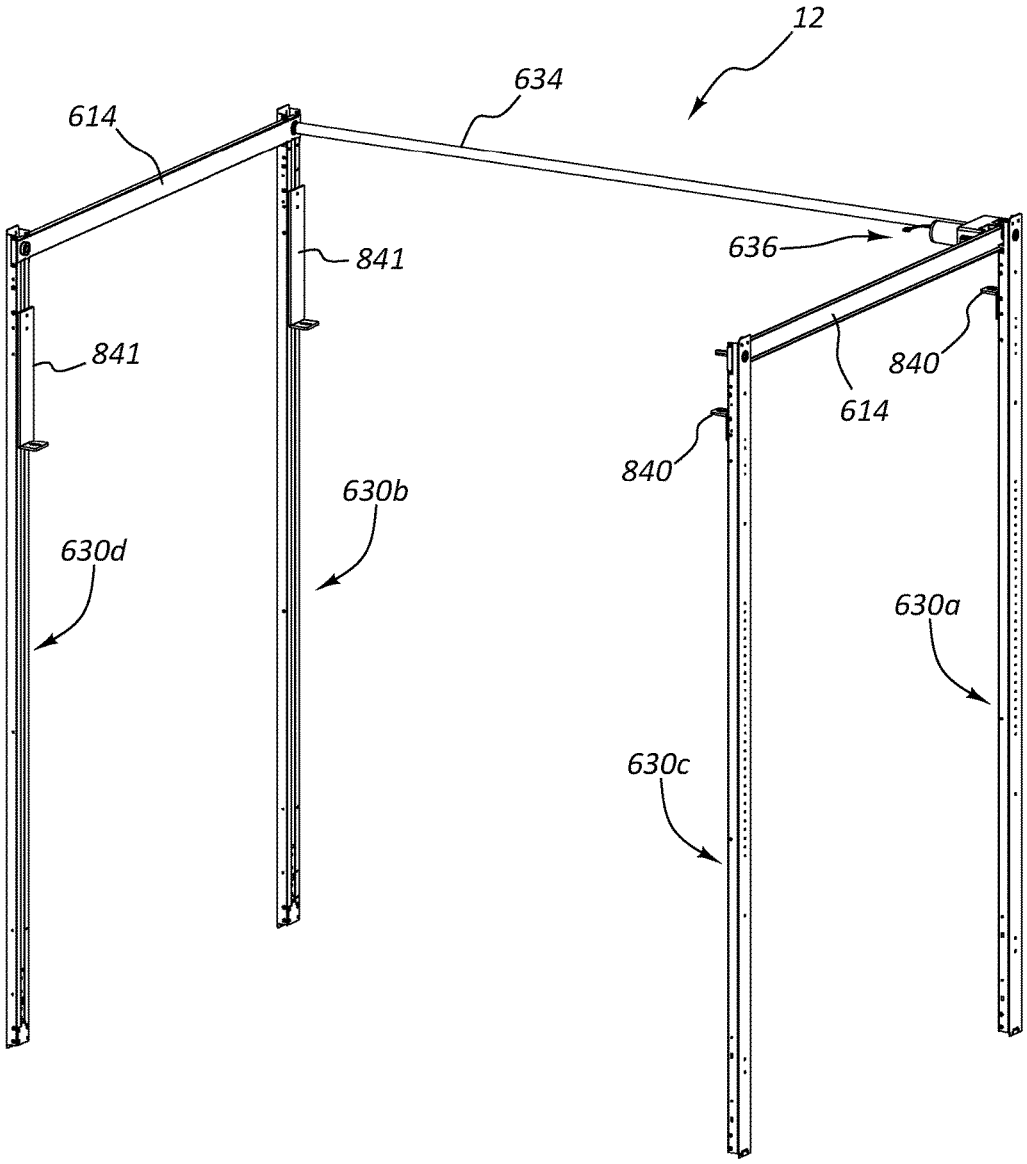
FIG. 12 is a perspective view of the lift system in FIG. 1.
Figure 13:
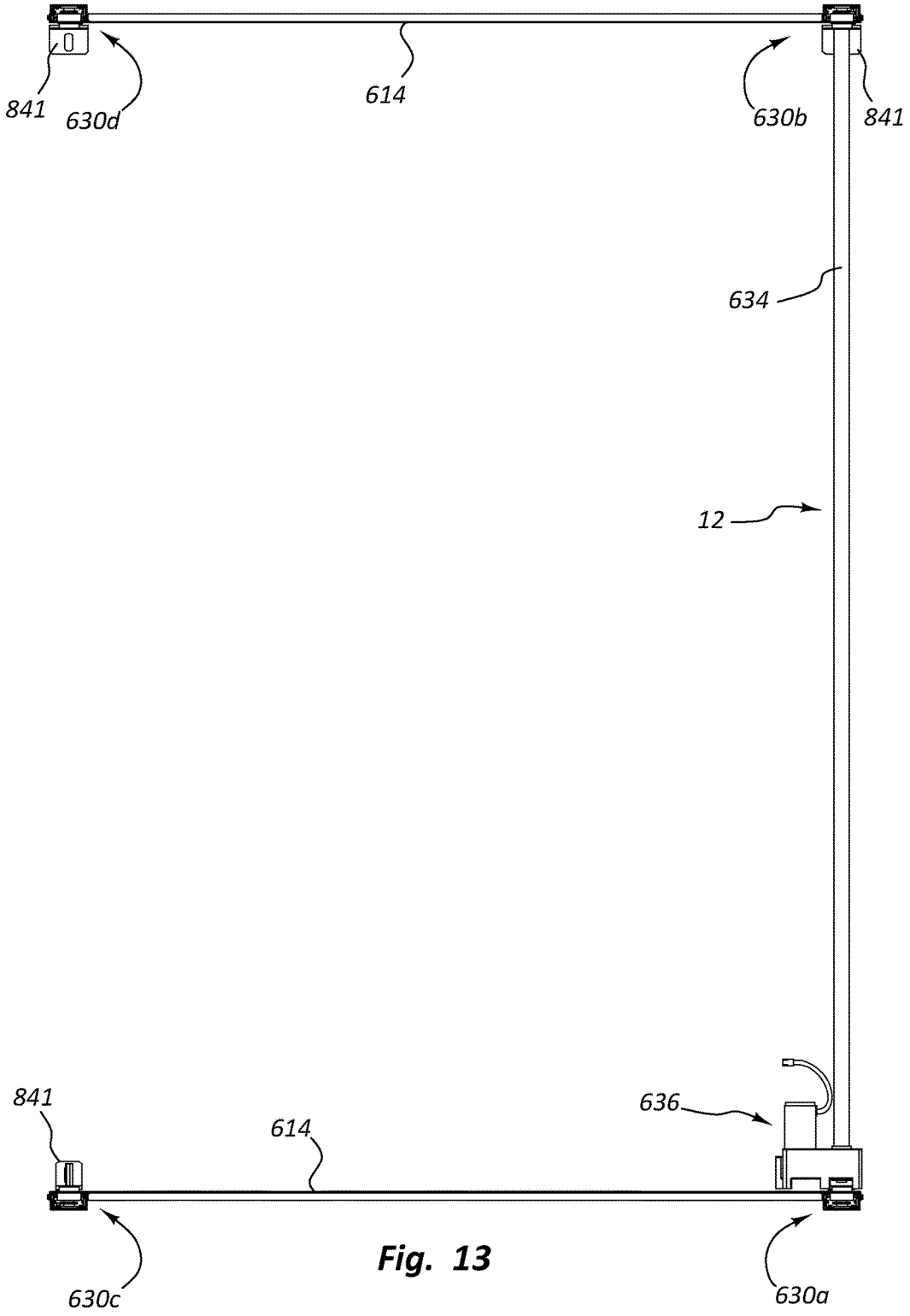
FIG. 13 is a top view of the lift system in FIG. 1.
Figure 14:
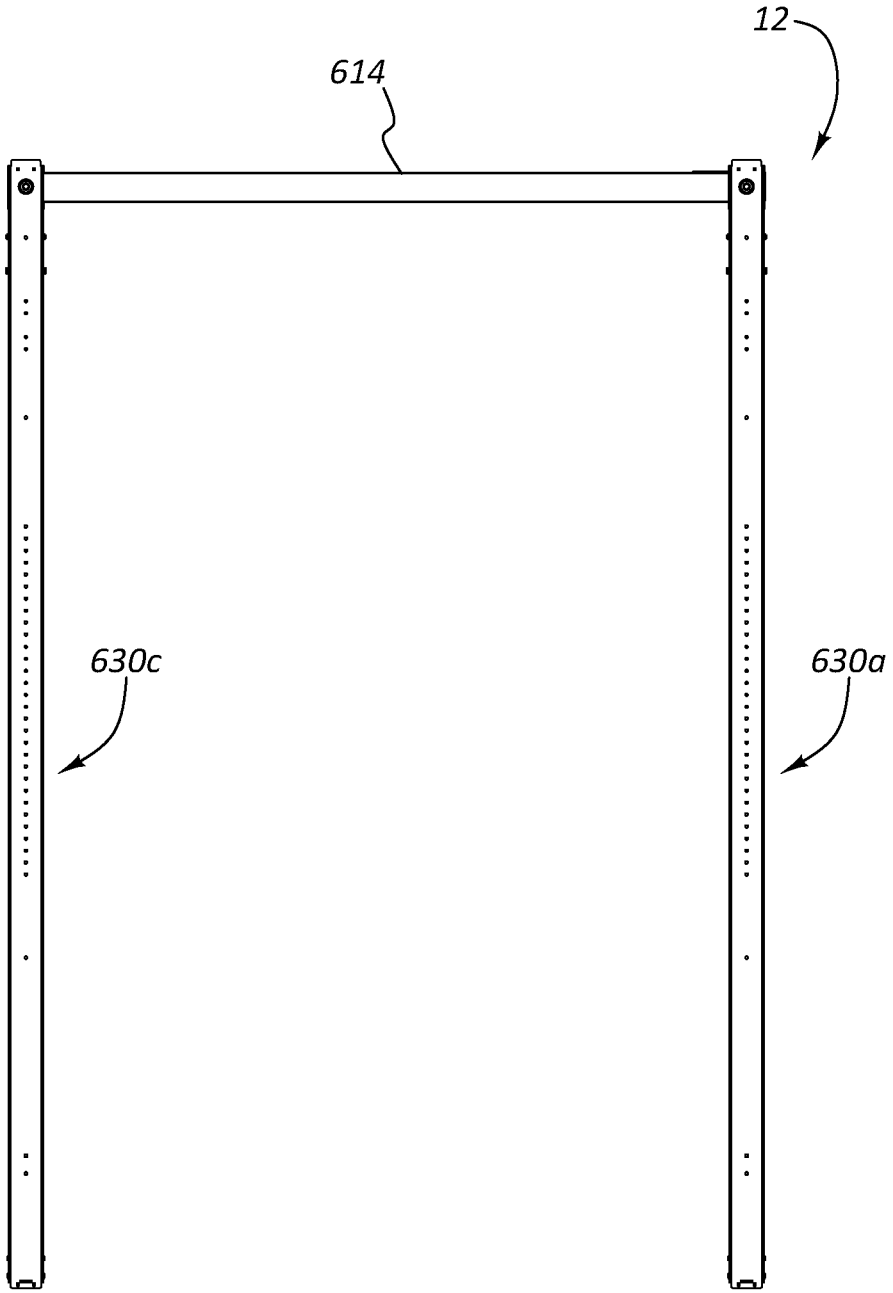
FIG. 14 is a right side view of the lift system in FIG. 1.
Figure 15:
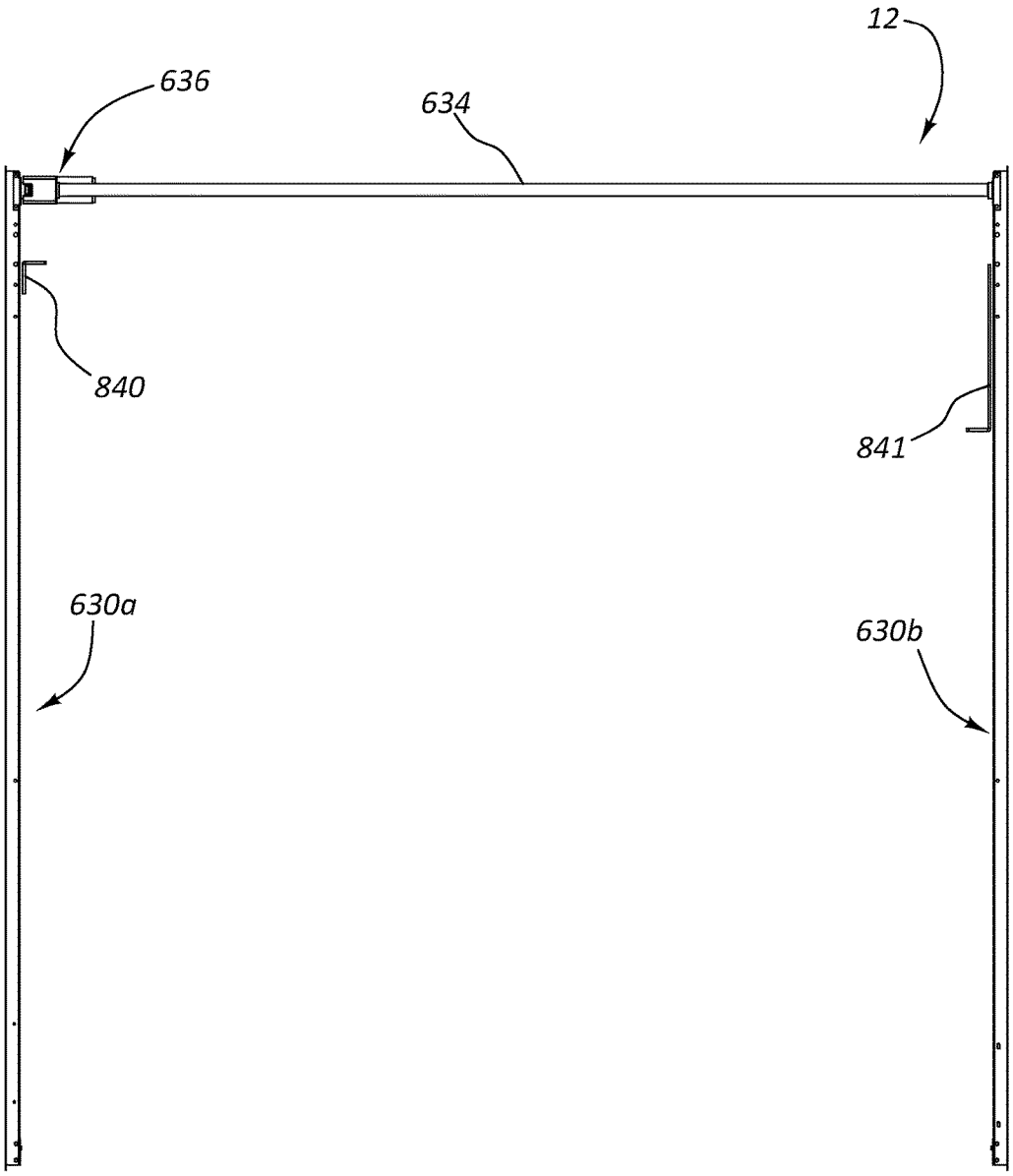
FIG. 15 is a rear view of the lift system in FIG. 1.

Referring to FIGS. 6-7 and 12, the upper moving assemblies 651 are coupled to the item of furniture 643 and the lower moving assemblies 650 are not coupled to an item of furniture or anything else. The moving assemblies 650, 651 can be configured to cooperate with the corresponding guide assemblies 660 to vertically move the item of furniture 643 between the lowered position and the raised position. In one embodiment, the moving assemblies 650, 651 slidably cooperate with the guide assemblies 660 to vertically move the item of furniture 643.

The lifting system 12 can be installed in the structure in any of a number of ways. In one embodiment, the lifting system 12 can be installed by first coupling at least one of the lifting assemblies 630*a*, 630*c* to a first side wall. For example, the lifting assemblies 630*a*, 630*c* and the cross member 614 can be coupled as an assembled unit to the first side wall 16. At least one of the lifting assemblies 630*b*, 630*d* can then be coupled to a second side wall. Desirably, the lifting assemblies 630*b*, 630*d* and the cross member 614 can also be coupled as an assembled unit to the second side wall. The drive member 634 can then be coupled between the pairs of lifting assemblies 630 coupled to each side wall. The process of installing the lifting system 12 is simple and efficient.

It should be appreciated that many additional ways can be used to install or couple the lifting system 12 to the structure. For example, the order in which the lifting assemblies 630 are coupled to the side walls can be varied. Also, in another embodiment, the lifting assemblies 630 can be coupled to the side walls before the cross members 614 are coupled between the lifting assemblies 630. Numerous additional modifications can be made to the installation method.

FIGS. 6-7 show perspective views of the lifting assemblies 630*a*, 630*c* and the lifting assemblies 630*b*, 630*d*, respectively. The moving assemblies 650, 651 each include a moving member 620, 622, respectively, (the moving members 620, 622 can alternatively be referred to herein as housings, brackets, moving guide members, or sliding members) and the guide assemblies 660 each include a guide member 618 (alternatively referred to herein as a support member, a channel member, rail, or a stanchion).

Each lifting assembly 630*a*, 630*b*, 630*c*, 630*d* includes a flexible drive member 616*a*, 616*b*, 616*c*, 616*d* (collectively referred to as "the flexible drive members 616") which are used to vertically move the moving members 620, 622 in cooperation with the guide members 618. Also, the flexible drive members 632, 638 are used to move the adjacent lifting assemblies 630*a*, 630*c* and the adjacent lifting assemblies 630*b*, 630*d*, respectively, in unison. The drive member 634 is used to synchronize movement of the lifting assemblies 630*a*, 630*c* and the lifting assemblies 630*b*, 630*d*. Thus, the flexible drive members 632, 638 and the drive member 634 are used to move all of the lifting assemblies 630 in unison.

It should be appreciated that the configuration of the drive members 632, 634, 638 can be varied in a number of ways. For example, the flexible drive member 632 can be configured to move the lifting assemblies 630*a*, 630*c* together with one drive member 634 extending between the lifting assemblies 630*a*, 630*b* and another drive member 634 extending between the lifting assemblies 630*c*, 630*d*. Thus, in this embodiment, two drive members 634 can be used and the flexible drive member 638 can be eliminated. Also, the flexible drive member 632 can be positioned anywhere as long as it extends between and is capable of moving the two drive members 634 together. For example, the flexible drive member 632 can be positioned in the middle of the ceiling 24 and configured to extend between the two drive members 634. Numerous additional configurations of the drive members 632, 634, 638 can also be provided so long as the lifting assemblies move in unison.

In the embodiments shown in FIGS. 6-7, the flexible drive members 616 form endless loops in each of the guide members 618. The flexible drive member 616 in each endless loop travels along an endless path. For example, as shown in FIG. 6, the flexible drive member 616*a* forms an endless loop which extends between an upper or first end 624 of the lifting assembly 630*a* and a lower or second end 626 of the lifting assembly 630*a*. The flexible drive members 616*b*, 616*c*, 616*d* form endless loops in the lifting assemblies 630*b*, 630*c*, 630*d*, respectively, in a similar manner. The endless loops formed by the flexible drive members 616 are generally oriented vertically in a plane which is parallel to the side walls of the structure.

It should be understood that the flexible drive members 616 can be used to form the entire endless loop, such as when the flexible drive members 616 are continuous loops of chain, or to form a part of the endless loop such as when the flexible drive members 616 are chains where a rigid component (e.g., moving member 620) is coupled between the ends of each of the chain. Either way, an endless loop is provided which travels along an endless path.

Each endless loop formed by the flexible drive members 616 includes a load bearing or first side 642 and a return or second side 644. The flexible drive members 616 each include a load bearing portion 652 (alternatively referred to herein as a load bearing length or load bearing segment) on the load bearing side 642 of the endless loop, which extends from the location of the load—the moving assembly 650 in this embodiment—vertically to the upper end 624 of the lifting assemblies 630 where the load is supported. The load bearing portion 652 is generally that portion of the flexible drive members 616 which bears the load as the item of furniture 643 is moved vertically.

The flexible drive members 616 also each include a return portion 654—alternatively referred to herein as a slack portion, return length, or return segment—on the return side 644 of the endless loop, which, in general, is the portion of the flexible drive members 616 that do not bear the load as the item of furniture 643 is raised and lowered. The load bearing side 642, in the embodiment shown in FIGS. 6-7, includes the load bearing portion 652 and part of the return portion 654 (i.e., the portion of the flexible drive member 616 that extends downward from the moving assembly 650 to the lower end 626 of the lifting assembly 630). The return side 644, in this embodiment, only includes return portion 654. It should be appreciated that the load bearing portion 652 gets smaller as the moving assembly 650 is raised and that the flexible drive member 616 that was formerly part of the load bearing portion 652 becomes part of the return portion 654.

The load bearing sides 642 and the return sides 644 of the flexible drive members 616 extend vertically lengthwise relative to the side walls and are, more or less, parallel to each other. In one embodiment, the load bearing portions 652 are coupled to the lower moving assemblies 650 so that the lower moving assemblies 650 and the flexible drive members 616 move along the endless paths defined by the endless loops at the same rate. The return portions 654 of the flexible drive members 616 are configured to move in the opposite direction of the moving assemblies 650, 651. For example, as the lower moving assemblies 650 are being raised, the return portions 654 move downwardly.

The flexible drive members 632, 638 are used to move the respective lifting assemblies 630 in unison. Each of the flexible drive members 632, 638 includes a load bearing or first side 646 and a return or second side 648. A taut portion or length 656 of the flexible drive members 632, 638 on the load bearing side 646 bears the weight of the item of furniture 643 at any given time. A slack portion or length 658 of the flexible drive members 632, 638 on the return side 648 serves to close the endless loop. Both the taut portions 656 and the slack portions 658 extend between the upper ends 624 of adjacent lifting assemblies 630 and are generally parallel to each other. The taut portions 656 are the portion of the flexible drive members 632, 638 which, at any given time, are in tension due to the weight of the lower moving assemblies 650 and the item of furniture 643.

It should be appreciated that the configuration of the flexible drive members 616, 632, 638 can be varied in a number of ways. For example, the load bearing sides 642 and the return sides 644 of the flexible drive members 616 can be switched with each other. This can be done by coupling the flexible drive members 616 to the lower moving assemblies 650 using what was previously the return sides 644. Thus, the return sides 644 become the load bearing sides 642 and what was once the load bearing sides 642 become the return sides 644. Also, by switching the load bearing sides 642 and the return sides 644 of the flexible drive members 616 with each other, the load bearing sides 646 and the return sides 648 of the flexible drive members 632, 638 are switched as well.

In operation, the motor assembly 636 is used to move the flexible drive members 616 along the endless paths. Since the lower moving assemblies 650 are coupled to the flexible drive members 616, the lower moving assemblies 650 also move along the endless path. For example, as shown in FIGS. 81-82, as the load bearing portion 652 of the flexible drive member 616*a* moves upward, the moving assembly 650*a* rises and the flexible drive member 632 in the taut portion 656 moves toward the upper end 624 of the lifting assembly 630*a*. As the flexible drive member 632 moves in this manner, the load bearing portion 652 of the flexible drive member 616*c* also moves upward, thus raising the moving assembly 650*c*. At the same time, the rotary motion provided by the motor assembly 636 is transmitted by the drive member 634 to the flexible drive member 616*b*. The load bearing portion 652 of the flexible drive member 616*b* moves upward as the drive member 634 rotates, thus raising the moving assembly 650*b*. As the flexible drive member 616*b* moves in this manner, the flexible drive member 638 in the taut portion 656 moves toward the upper end 624 of the lifting assembly 630*b*. By moving the flexible drive member 638 in this manner, the load bearing portion 652 of the flexible drive member 616*d* moves upward, thus raising the moving assembly 650*d*. In this manner, the lower moving assemblies 650 can be moved in unison to move the item of furniture 643 to any desired vertical position.

In one embodiment, the flexible drive members 616 are roller chains. In this embodiment, one or more sprockets can be provided at the upper end 624 and/or the lower end 626 to facilitate movement of the flexible drive members 616 along the endless path. In one embodiment, the roller chain can be #35 roller chain. The roller chain can also be corrosion resistant (e.g., nickel plated, stainless steel, etc.). In another embodiment, the flexible drive members 616 can be toothed belts. The toothed belts can have straight teeth or can have helical offset teeth. The toothed belts can be configured to cooperate with a corresponding sprocket having the same tooth design. In one embodiment, the toothed belt can be a polyurethane toothed belt.

It should be appreciated that the flexible drive members 616 can be configured in a number of suitable ways beyond what is shown in FIGS. 6-7. For example, the flexible drive members 616 can be configured to move along a path that is not endless. Also, the flexible drive members 616 can be any suitable flexible material such as a V-shaped belt, etc. Also, in another embodiment, the flexible drive members 616 and the cross members 614 can extend between the lower ends 626 of the lifting assemblies 630. Further still, the flexible drive members 632, 638 which extend between the lifting assemblies 630*a*, 630*c* and the lifting assemblies 630*b*, 630*d*, respectively, can be substituted with a rigid drive member.

The drive member 634 can be positioned between the motor assembly 636 and the drive shaft 670*b* in the manner described in the '881 patent. Holes 628 in the upper ends 624 of the lifting assemblies 630 can be used to couple the lifting assemblies 630 to the side walls of the structure. The holes 628 can be used to receive any of a number of suitable fasteners which are used to couple the lifting assemblies 630 to the side walls. For example, in one embodiment, bolts or screws can extend through the holes 628 and into the side walls to securely hold the lifting assemblies 630*a*, 630*c* in place. Also, the lower ends 626 of the lifting assemblies 630 can include the holes 628 and, thus, can be capable of being coupled to the side walls as well.

It should be appreciated that the ways in which the lifting assemblies 630 can be coupled to the structure are numerous. For example, in another embodiment, the holes 628 can be included in the middle of the lifting assemblies 630. Also, flanges can be included which extend outward from the guide members 618 adjacent to and parallel with the side walls. The flanges can include the holes 628 so that fasteners can be used to couple the flanges and, thus, the lifting assemblies 630 to the side walls.

The lifting system 12 includes mounting members 840, 841 as shown best in FIG. 12. The mounting members 840, 841 are coupled to the front side of the upper moving members 622 so that the mounting members 840, 841 extend through the gap in front of the guide members 618 (FIGS. 6-7). The mounting members 840, 841 can have any suitable shape. In one embodiment, the mounting members 840, 841 are L-shaped brackets. In other embodiments, the mounting members 840, 841 can be a plate, a box, etc. Also, the mounting members 840, 841 can be made from plastic, metal, composites and the like.

The mounting members 840, 841 are used to couple the item of furniture 643 to the moving assemblies 651. There are numerous ways that this can be accomplished. For example, the mounting members 840, 841 can include an opening configured to receive a pin on the item of furniture 643. Also, the mounting members 840, 841 can be screwed to the item of furniture 643.

The moving assemblies 650, 651 can be configured to vertically move the item of furniture 643 by sliding in cooperation with the interior of the guide member 618. As shown in FIGS. 6-7, each flexible drive member 616 extends through the moving members 620, 622, respectively. The flexible drive members 616 are coupled to the moving members 620 so that the moving members 620 move as the flexible drive members 616 move. The moving members 622 are configured to move independently of the flexible drive members 616.

In one embodiment, a drive assembly can be used to move the item of furniture 643 vertically between the use configuration 610 and the stowed configuration 612. The drive assembly includes those components which are used to drive the vertical movement of the item of furniture 643. For example, in this embodiment, the drive assembly includes the flexible drive members 616, 632, 638, the drive member 634, and the motor assembly 636.

The drive assembly can be used to move the item of furniture 643 vertically along a path between the lowered position and the raised position. This is done by actuating the motor assembly 636 which causes the flexible drive members 616 to move along the path in the manner described above. The lower moving members 620 are coupled to and move with the flexible drive members 616 along the path.

The upper moving members 622 rest on and are supported by the lower moving members 620 but are not attached to the lower moving members 620. This makes it possible for the upper moving members 622 to freely move upward in the channels defined by the guide members 618. Downward movement of the upper moving members 622 is prevented by the presence of the lower moving members 620. The item of furniture 643 is coupled to the upper moving members 622 so it is also capable of moving in the same way.

The lifting system 12 can move the item of furniture from the raised position to the lowered position as follows. The motor assembly 636 is actuated to cause the lower moving members 620 to move downward in the channel in the guide members 618. The upper moving members 622 also move downward but they are not pulled downward by the lower moving members 620. Instead, the upper moving members 622 move downward solely due to gravity. Likewise, the item of furniture 643 moves in the same fashion because it is coupled to the upper moving members 622.

When the item of furniture 643 reaches the support base 645, the weight of the item of furniture 643 is transferred to the support base 645. The lower moving members 620 are not coupled to the upper moving members 622 so they can continue to move downward until they no longer provide any support to the upper moving members 622. In this configuration, the upper moving members 622 are effectively unsupported by the guide members 618 or the lifting system 12. The support base 645 is the only thing supporting the item of furniture 643 and the upper moving members 622.

The advantage of this configuration is that it allows different portions of the item of furniture 643 to contact the support base 645 at different times during the lowering process. However, once the item of furniture 643 is in the lowered position and the lower moving members 620 are no longer in contact with the upper moving members 622, then the item of furniture 643 is supported entirely by the support base 645 (or the floor of the structure depending on the embodiment).

This configuration differs from that shown in the '881 patent because the upper moving assemblies 622 are used to support an item of furniture 643 that rests on the floor or on a support base on the floor and/or the item of furniture 643 is lowermost item of furniture coupled to the lifting system 12. In the '881 patent, the upper moving assemblies 622 are not used to support the lowermost item of furniture or to support an item of furniture on the floor. There are also other differences between this configuration and those shown in the '881 patent.

It should be appreciated that the lifting system 12 can be used with a wide variety of mobile and immobile structures. Mobile structures include, but are not limited to, structures such as land vehicles (e.g., recreational vehicles, trailers, motorized vehicles, vehicles used to travel on a road, wheeled vehicles, railroad cars, buses, semi-trucks, and the like), watercraft (e.g., ships, boats, houseboats, cruise ships, yachts, and the like), aircraft, and any other mobile vehicles. Immobile structures include, but are not limited to, structures such as a building, edifice, etc.

In some embodiments, the lifting system 12 can be used with structures that are used as or include living quarters. For example, the lifting system 12 can be used with homes, houses, residences, condominiums, abodes, dwellings, lodgings, recreational vehicles (e.g., travel trailers, fifth wheels, truck campers, "toy haulers," snowmobile trailers, motor homes, car haulers (e.g., vehicles used to haul cars and/or other vehicles to races such as NASCAR races, etc.) and the like), houseboats, cruise ships, and the like. In other embodiments, the lifting system 12 can be used with any structure which is suitable for or designed principally for habitation by people either on a permanent (e.g., a house) or a temporary (e.g., hotel) basis.

Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The term "coupled" includes joining that is permanent in nature or releasable and/or removable in nature. Permanent joining refers to joining the components together in a manner that is not capable of being reversed or returned to the original condition. Releasable joining refers to joining the components together in a manner that is capable of being reversed or returned to the original condition.

Releasable joining can be further categorized based on the difficulty of releasing the components and/or whether the components are released as part of their ordinary operation and/or use. Readily or easily releasable joining refers to joining that can be readily, easily, and/or promptly released with little or no difficulty or effort. Difficult or hard to release joining refers to joining that is difficult, hard, or arduous to release and/or requires substantial effort to release. The joining can be released or intended to be released as part of the ordinary operation and/or use of the components or only in extraordinary situations and/or circumstances. In the latter case, the joining can be intended to remain joined for a long, indefinite period until the extraordinary circumstances arise.

It should be appreciated that the components can be joined together using any type of fastening method and/or fastener. The fastening method refers to the way the components are joined. A fastener is generally a separate component used in a mechanical fastening method to mechanically join the components together. A list of examples of fastening methods and/or fasteners are given below. The list is divided according to whether the fastening method and/or fastener is generally permanent, readily released, or difficult to release.

Examples of permanent fastening methods include welding, soldering, brazing, crimping, riveting, stapling, stitching, some types of nailing, some types of adhering, and some types of cementing. Examples of permanent fasteners include some types of nails, some types of dowel pins, most types of rivets, most types of staples, stitches, most types of structural ties, and toggle bolts.

Examples of readily releasable fastening methods include clamping, pinning, clipping, latching, clasping, buttoning, zipping, buckling, and tying. Examples of readily releasable fasteners include snap fasteners, retainer rings, circlips, split pin, linchpins, R-pins, clevis fasteners, cotter pins, latches, hook and loop fasteners (VELCRO), hook and eye fasteners, push pins, clips, clasps, clamps, zip ties, zippers, buttons, buckles, split pin fasteners, and/or conformat fasteners.

Examples of difficult to release fastening methods include bolting, screwing, most types of threaded fastening, and some types of nailing. Examples of difficult to release fasteners include bolts, screws, most types of threaded fasteners, some types of nails, some types of dowel pins, a few types of rivets, a few types of structural ties.

It should be appreciated that the fastening methods and fasteners are categorized above based on their most common configurations and/or applications. The fastening methods and fasteners can fall into other categories or multiple categories depending on their specific configurations and/or applications. For example, rope, string, wire, cable, chain, and the like can be permanent, readily releasable, or difficult to release depending on the application.

Any methods described in the claims or specification should not be interpreted to require the steps to be performed in a specific order unless stated otherwise. Also, the methods should be interpreted to provide support to perform the recited steps in any order unless stated otherwise.

Spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The terms have, having, include, and including should be interpreted to be synonymous with the terms comprise and comprising. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The drawings shall be interpreted as illustrating one or more embodiments that are drawn to scale and/or one or more embodiments that are not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any and all ranges or subranges that can be formed by such values.

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

INCORPORATION BY REFERENCE

The entire contents of each of the documents listed below are incorporated by reference into this document. If the same term is used in both this document and one or more of the incorporated documents, then it should be interpreted to have the broadest meaning imparted by any one or combination of these sources unless the term has been explicitly defined to have a different meaning in this document. If there is an inconsistency between any of the following documents and this document, then this document shall govern. The incorporated subject matter should not be used to limit or narrow the scope of the explicitly recited or depicted subject matter.

U.S. Prov. App. No. 62/366,990, titled "Lift System," filed on 26 Jul. 2017.

U.S. Pat. No. 9,380,881 (application Ser. No. 14/177,936), titled "Strap Bed Lift," filed on 11 Feb. 2014, issued on 5 Jul. 2016 (the '881 patent).

The invention claimed is:

1. A structure comprising:

an item of furniture; and a lifting system configured to move the item of furniture vertically along a path between a lowered position and a raised position;

wherein the item of furniture is coupled to the lifting system in a manner that allows the item of furniture to move upward along the path when the lifting system is stationary; and wherein the item of furniture is supported on a floor of the structure when the item of furniture is in the lowered position.

2. The structure of claim 1 wherein the lifting system moves the item of furniture from the lowered position to the raised position and only gravity moves the item of furniture from the raised position to the lowered position.

3. The structure of claim 1 wherein the lifting system controls downward movement of the item of furniture along at least a majority of the path, and wherein the item of furniture can move freely upward along at least a majority of the path.

4. The structure of claim 1 wherein the lifting system comprises a moving member that supports the item of furniture and moves along the path, and wherein the item of furniture is movable upward relative to the moving member.

5. The structure of claim 4 wherein the moving member is not coupled to another item of furniture.

6. The structure of claim 1 wherein the item of furniture is the lowermost item of furniture coupled to the lifting system.

7. The structure of claim 1 comprising a support base positioned on the floor, wherein the item of furniture is supported solely by the support base when the item of furniture is in the lowered position.

8. The structure of claim 1 wherein the lifting system comprises a flexible drive member extending vertically along the path, and wherein the lifting system is configured to move the item of furniture along the path between the lowered position and the raised position.

9. The structure of claim 8 wherein the path is an endless path, and wherein the flexible drive member is configured to reciprocally move the item of furniture along the endless path between the lowered position and the raised position.

10. The structure of claim 8 wherein the lifting system comprises a moving member coupled to the flexible drive member, and wherein the item of furniture is supported by the moving member.

11. The structure of claim 8 wherein the flexible drive member comprises a roller chain that forms at least part of the path.

12. The structure of claim 8 wherein the flexible drive member comprises a cable that forms at least part of the path.

13. A structure comprising:

an item of furniture; and a lifting system configured to move the item of furniture vertically along a path between a lowered position and a raised position;

wherein the item of furniture is coupled to the lifting system in a manner that allows the item of furniture to move upward along the path when the lifting system is stationary; and wherein the item of furniture is the lowermost item of furniture coupled to the lifting system.

14. The structure of claim 13 wherein the lifting system moves the item of furniture from the lowered position to the raised position and only gravity moves the item of furniture from the raised position to the lowered position.

15. The structure of claim 13 wherein the lifting system controls downward movement of the item of furniture along at least a majority of the path, and wherein the item of furniture can move freely upward along at least a majority of the path.

16. The structure of claim 13 wherein the lifting system comprises a moving member that supports the item of furniture and moves along the path, and wherein the item of furniture is movable upward relative to the moving member.

17. The structure of claim 16 wherein the moving member is not coupled to another item of furniture.

18. The structure of claim 13 comprising a support base positioned on a floor of the structure, wherein the item of furniture is supported solely by the support base when the item of furniture is in the lowered position.

19. The structure of claim 13 wherein the lifting system comprises a flexible drive member extending vertically along the path, and wherein the lifting system is configured to move the item of furniture along the path between the lowered position and the raised position.

20. The structure of claim 19 wherein the path is an endless path, and wherein the flexible drive member is configured to reciprocally move the item of furniture along the endless path between the lowered position and the raised position.

21. The structure of claim 19 wherein the lifting system comprises a moving member coupled to the flexible drive member, and wherein the item of furniture is supported by the moving member.

22. The structure of claim 19 wherein the flexible drive member comprises a roller chain that forms at least part of the path.

23. The structure of claim 19 wherein the flexible drive member comprises a cable that forms at least part of the path.

* * * * *